US009920406B2

(12) United States Patent
Sun

(10) Patent No.: US 9,920,406 B2
(45) **Date of Patent: *Mar. 20, 2018**

(54) METHOD FOR MANUFACTURING HIGH-PERFORMANCE NDFEB RARE EARTH PERMANENT MAGNETIC DEVICE

(71) Applicant: SHENYANG GENERAL MAGNETIC CO., LTD., Shenyang, Liaoning (CN)

(72) Inventor: Baoyu Sun, Liaoning (CN)

(73) Assignee: SHENYANG GENERAL MAGNETIC CO., LTD, Shenyang, Liaoning (CN)

( * ) Notice: Subject to any disclaimer, the term of this patent is extended or adjusted under 35 U.S.C. 154(b) by 386 days.

This patent is subject to a terminal disclaimer.

(21) Appl. No.: 14/709,046

(22) Filed: May 11, 2015

(65) Prior Publication Data

US 2015/0243416 A1 Aug. 27, 2015

(30) Foreign Application Priority Data

May 11, 2014 (CN) ..... 2014 1 0194943

(51) Int. Cl.

| | |
|---|---|
| ***H01F 1/057*** | (2006.01) |
| ***C22C 38/00*** | (2006.01) |
| ***H01F 41/02*** | (2006.01) |
| ***C22C 38/16*** | (2006.01) |
| ***C22C 38/14*** | (2006.01) |
| ***C22C 38/10*** | (2006.01) |
| ***C22C 38/06*** | (2006.01) |
| ***C22C 1/00*** | (2006.01) |
| ***C22C 38/32*** | (2006.01) |
| ***B22F 1/00*** | (2006.01) |
| ***B22F 9/02*** | (2006.01) |

(52) U.S. Cl.

CPC ..... *C22C 38/002* (2013.01); *B22F 1/004* (2013.01); *B22F 9/023* (2013.01); *C22C 1/002* (2013.01); *C22C 1/005* (2013.01); *C22C 38/005* (2013.01); *C22C 38/06* (2013.01); *C22C 38/10* (2013.01); *C22C 38/14* (2013.01); *C22C 38/16* (2013.01); *C22C 38/32* (2013.01); *H01F 1/0577* (2013.01); *H01F 41/0273* (2013.01); *B22F 2998/10* (2013.01); *B22F 2999/00* (2013.01)

(58) Field of Classification Search

CPC ..... B22F 1/004; B22F 9/008

See application file for complete search history.

(56) References Cited

U.S. PATENT DOCUMENTS

| | | | | |
|---|---|---|---|---|
| 7,056,393 | B2 * | 6/2006 | Tokuhara | H01F 1/0573 148/101 |
| 2014/0328711 | A1 * | 11/2014 | Sun | B22F 1/0081 419/20 |
| 2014/0328713 | A1 * | 11/2014 | Sun | B22F 9/08 419/29 |
| 2015/0243433 | A1 * | 8/2015 | Sun | B22F 9/04 148/102 |

FOREIGN PATENT DOCUMENTS

| | | | |
|---|---|---|---|
| CN | 101325109 | 12/2008 | |
| CN | 101364465 | 2/2009 | |
| CN | 101383210 | 3/2009 | |
| CN | 101521069 | 9/2009 | |
| WO | WO 02072900 A2 * | 9/2002 | C22C 1/0441 |

* cited by examiner

*Primary Examiner* — Colleen P Dunn
*Assistant Examiner* — Jeremy C Jones

(57) ABSTRACT

A method for manufacturing a high-performance NdFeB rare earth permanent magnetic device which is made of an R—Fe—Co—B-M strip casting alloy, a micro-crystal HR—Fe alloy fiber, and $T_mG_n$ compound micro-powder, includes steps of: manufacturing the R—Fe—Co—B-M strip casting alloy, manufacturing the micro-crystal HR—Fe alloy fiber, providing hydrogen decrepitating, pre-mixing, powdering with jet milling, post-mixing, providing magnetic field pressing, sintering and ageing, wherein after a sintered NdFeB permanent magnet is manufactured, machining and surface-treating the sintered NdFeB permanent magnet for forming a rare earth permanent device.

8 Claims, No Drawings

METHOD FOR MANUFACTURING HIGH-PERFORMANCE NDFEB RARE EARTH PERMANENT MAGNETIC DEVICE

CROSS REFERENCE OF RELATED APPLICATION

The present invention claims priority under 35 U.S.C. 119(a-d) to CN 201410194943.2, filed May. 11, 2014.

BACKGROUND OF THE PRESENT INVENTION

Field of Invention

The present invention relates to a field of permanent magnetic materials, and more particularly to a method for manufacturing a high-performance NdFeB rare earth permanent magnetic device.

Description of Related Arts

NdFeB rare earth permanent magnetic materials are more and more widely used due to excellent magnetic properties thereof For example, the NdFeB rare earth permanent magnetic materials are widely used in medical nuclear magnetic resonance imaging, computer hard disk drivers, stereos, cell phones, etc. With the requirements of energy efficiency and low-carbon economy, the NdFeB rare earth permanent magnetic materials are also used in fields such as automobile parts, household appliances, energy conservation and control motors, hybrid cars and wind power.

In 1983, Japanese patents No. 1,622,492 and No. 2,137,496 disclosed NdFeB rare earth permanent magnetic materials invented by Japanese Sumitomo Metals Industries, Ltd., which disclose features, components and manufacturing methods of the NdFeB rare earth permanent magnetic materials, and confirm that a main phase is a $Nd_2Fe_{14}B$ phase and a grain boundary phase comprises a rich Nd phase, a rich B phase and rare earth oxidants. NdFeB materials are widely used because of sufficient magnetic performance, and are called the king of permanent magnets. U.S. Pat. No. 5,645,651, authorized in 1997, further disclosed adding Co and the main phase having a square structure. The above patents are rigorous and therefore well protect the intellectual property. After purchasing Sumitomo Metal Industries, Ltd., Hitachi Metals, Ltd. filed a lawsuit against 29 enterprises comprising 3 Chinese NdFeB manufacturers to ITC in US with U.S. Pat. No. 6,461,565; U.S. Pat. No. 6,491,765; U.S. Pat. No. 6,537,385 and U.S. Pat. No. 6,527,874, wherein a patent family member of U.S. Pat. No. 6,461,565 is Chinese patent CN1195600C, which claims a temperature controlled at 5-30° C. during magnetic field pressing and a relative humidity of 40-65%. Although the above condition keeps safe and convenience during forming, an oxygen content is high, which wastes valuable rare earth resource and lowers performance A patent family member of U.S. Pat. No. 6,491,765 and U.S. Pat. No. 6,537,385 is Chinese patent CN1272809C, which claims a high-speed inert gas flow with a content of 0.02-5 during powdering with jet milling, for finely decrepitating alloys and removing at least a part of fine powder with a particle size less than 1.0 μm, so as to decrease a content of fine powder with the particle size less than 1.0 μm to lower than 10% of a total particle amount. Because the fine powder with the particle size less than 1.0 μm has a high rare earth content, a large surface area, is easiest to be oxidized, and is even easy to catch a fire, decrease thereof is conducive to process control and performance improvement. However, the rare earth is wasted. In addition, some fine powder with the particle size less than 1.0 μm is outputted through an outputting tube of a cyclone collector, which is controlled by a jet milling device and is difficult to be manually controlled. A patent family member of U.S. Pat. No. 6,527,874 is Chinese patent CN1182548C, which claims a strip casting alloy with Nb and Mo added, and a manufacturing method thereof. Strip casting alloy and manufacturing method thereof are firstly disclosed in U.S. Pat. No. 5,383,978, which greatly improves performance of NdFeB and has become a main manufacturing technology since 1997. Therefore, a lot of manpower and financial resources are used, resulting in rapid development of the technology. U.S. Pat. No. 5,690,752; CN97111284.3; CN1,671,869A; U.S. Pat. No. 5,908,513; U.S. Pat. No. 5,948,179; U.S. Pat. No. 5,963,774 and CN1,636,074A are all improvement of the technology.

With wide application of the NdFeB rare earth permanent magnets, rare earth is more and more rare. Especially, shortage of heavy rare earth element resource is significant, and price of the rare earth is continuously increasing. Therefore, after a lot of searching, double-alloy technology, metal infiltration technology, grain boundary improving or recombining technology, etc. appear. Chinese patent CN101521069B disclose a NdFeB manufacturing technology with heavy rare earth hydride nano-grain mixed, invented by Yue, ming et al. of Beijing University of Technology, wherein alloy flakes is firstly manufactured with strip casting technology, then powder is formed by hydrogen crushing and jet milling, the above power is mixed with heavy rare earth hydride nano-grains formed by physical vapor deposition technology, and then NdFeB magnet is manufactured through conventional processes such as magnetic field pressing and sintering. Although the Chinese patent discloses a method to enhance coercivity of magnet, research is not thorough enough and there is problem for mass production. Patents CN101,383,210B; CN101,364,465B; and CN101,325,109B disclose similar technologies, wherein performance is slightly improved, nano oxide is easy to absorb moisture, adsorbed water seriously affects product performance, and product consistency is poor.

SUMMARY OF THE PRESENT INVENTION

After researches, the present invention provides a method for manufacturing a high-performance NdFeB rare earth permanent magnetic device, which significantly improves magnetic energy product, coercivity, anti-corrosion and processing property of NdFeB rare earth permanent magnet. The method is suitable for mass production and uses less heavy rare earth elements which are expensive and rare. The method is important for widening application of NdFeB rare earth permanent magnetic materials, especially in fields such as electronic components, energy conservation and control motors, automobile parts, hybrid cars and wind power. The present invention also discloses that micro $T_mG_n$ compound and $Nd_2O_3$ grains exist in a grain boundary phase at a border of more than two $ZR_2(Fe_{1-x}Co_x)_{14}B$ phase grains which inhibits abnormal growth of grains, and also discloses a main phase structure with a $ZR_2(Fe_{1-x}Co_x)_{14}B$ phase surrounding a $LR_2(Fe_{1-x}Co_x)_{14}B$ phase.

Accordingly, the present invention provides:

a method for manufacturing a high-performance NdFeB rare earth permanent magnetic device, wherein the high-performance NdFeB rare earth permanent magnetic device is made of an R—Fe—Co—B-M strip casting alloy, a micro-crystal HR—Fe alloy fiber, and $T_mG_n$ compound micro-powder, wherein the R comprises at least two rare earth elements, wherein the R at least comprises Nd and Pr;

the M is selected from a group consisting of Al, Co, Nb, Ga, Zr, Cu, V, Ti, Cr, Ni and Hf;

the HR is selected from a group consisting of Dy, Tb, Ho and Y;

the $T_mG_n$ compound micro-powder is selected from a group consisting of $La_2O_3$, $Ce_2O_3$, $Dy_2O_3$, $Tb_2O_3$, $Y_2O_3$, $Al_2O_3$, $ZrO_2$ and BN;

Fe, B, Co, O and N are element symbols of corresponding elements.

Preferably, the $T_mG_n$ compound micro-powder is selected from a group consisting of $Dy_2O_3$, $Tb_2O_3$ and $Y_2O_3$.

More, preferably, the $T_mG_n$ compound micro-powder is selected from a group consisting of $Al_2O_3$, $ZrO_2$ and BN.

An adding amount of the $T_mG_n$ compound micro-powder is: $0<T_mG_n\leq 0.6\%$.

Preferably, an adding amount of the micro-crystal HR-Fe alloy fiber is: $0\leq HR—Fe\leq 10\%$.

More preferably, an adding amount of the micro-crystal HR-Fe alloy fiber is: $1\leq HR—Fe\leq 8\%$.

The method comprises steps of:

(1) manufacturing the R—Fe—Co—B-M strip casting alloy:

firstly melting an R—Fe—Co—B-M raw material under vacuum or argon protection with induction heating for forming an alloy, fining before casting the alloy in a melted state onto a rotation roller through a tundish, and cooling the alloy with the rotation roller for forming alloy flakes, outputting the alloy flakes after being cooled;

preferably, melting an R—Fe—Co—B-M raw material under vacuum or argon protection with induction heating for forming an alloy, fining at 1400-1470° C. before casting the alloy in a melted state onto a rotation copper roller with a rotation speed of 1-4 m/s through a tundish, and cooling the alloy with the rotation roller for forming alloy flakes, wherein after leaving the rotation copper roller, the alloy flakes drop to a rotation disk for secondary cooling; outputting the alloy flakes after being cooled;

more preferably, melting an R—Fe—Co—B-M raw material under vacuum or argon protection with induction heating for forming an alloy, fining at 1400-1470° C. before casting the alloy in a melted state onto a rotation copper roller with a rotation speed of 1-4 m/s through a tundish, and cooling the alloy with the rotation roller for forming alloy flakes, wherein after leaving the rotation copper roller, the alloy flakes drop; crushing the alloy flakes and sending into a receiving tank, then cooling the alloy flakes with inert gas;

even more preferably, melting an R—Fe—Co—B-M raw material under vacuum or argon protection with induction heating for forming an alloy, fining at 1400-1470° C. before casting the alloy in a melted state onto a rotation copper roller with a rotation speed of 1-4 m/s through a tundish, and cooling the alloy with the rotation roller for forming alloy flakes, wherein a temperature of the alloy flakes is 400-700° C., after leaving the rotation copper roller, the alloy flakes drop to a rotation disk for secondary cooling to a temperature of less than 400° C.; crushing the alloy flakes and then keeping the temperature at 200-600° C. before cooling the alloy flakes with inert gas;

wherein an average grain size of the strip casting alloy is 1-4 μm, preferably 2-3 μm;

(2) manufacturing the micro-crystal HR—Fe alloy fiber:

adding an HR—Fe alloy into a water-cooled cooper crucible of an arc-heating vacuum quenching furnace under an argon atmosphere, melting the HR—Fe alloy with an electric arc, contacting melted alloy liquid with a periphery of a water-cooled high-speed rotating molybdenum wheel, in such a manner that the melted alloy liquid is thrown out for forming the micro-crystal HR—Fe alloy fiber; wherein a speed of the periphery of the water-cooled high-speed rotating molybdenum wheel is higher than 10 m/s, preferably 25-40 m/s;

(3) providing hydrogen decrepitating:

sending the R—Fe—Co—B-M strip casting alloy flakes and the micro-crystal HR—Fe alloy fiber into a vacuum hydrogen decrepitation device, evacuating before injecting hydrogen for hydrogen absorption, wherein a hydrogen absorption temperature is 80-120° C.; heating after hydrogen absorption and evacuating for dehydrogenating, wherein a dehydrogenating temperature is 350-900° C., a temperature keeping time is 3-15 h; cooling after temperature keeping, outputting after a temperature is lower than 80° C.;

(4) pre-mixing:

adding the alloy flakes which is decrepitated in the step (3), the micro-crystal HR—Fe alloy fiber which is decrepitated in the step (3) and the $T_mG_n$ compound micro-powder into a mixer for pre-mixing, wherein pre-mixing is provided under nitrogen protection, lubricant or anti-oxidant may be added, a pre-mixing time is more than 30 min; powdering with nitrogen protected jet milling after mixing;

(5) powdering with jet milling:

after pre-mixing, adding powder into a hopper on a top portion of a feeder, moving the pre-mixed powder into a milling room through the feeder, milling with high-speed flow from a spray nozzle, wherein the powder milled rises with the flow; sorting powder suitable for powdering with a sorting wheel and collecting in a cyclone collector; wherein coarse powder unsuitable for powdering returns with a centrifugal force to the milling room for milling; storing the powder collected as an end product in a storage device under the cyclone collector, filtering super-fine powder outputted with outputting gas of the cyclone collector with a filter and storing in a super-fine powder collector under the filter; wherein the outputting gas enters a gas entry of a nitrogen compressor and then is compressed to 0.6-0.8 MPa by the nitrogen compressor before being sprayed through the spray nozzle, nitrogen is re-used, an oxygen content in a powdering atmosphere is less than 100 ppm, preferably less than 50 ppm;

wherein according to analysis, contents of the micro-crystal HR—Fe alloy powder and the $T_mG_n$ compound micro-powder are high, which illustrates that some micro-crystal HR—Fe alloy powder and some $T_mG_n$ compound micro-powder are in the powder collected by the filter; contents of the micro-crystal HR—Fe alloy powder and the $T_mG_n$ compound micro-powder in the powder collected by the filter are significantly higher than the contents of the micro-crystal HR—Fe alloy powder and the $T_mG_n$ compound micro-powder in the powder collected by the cyclone collector; the micro-crystal HR—Fe alloy powder is oxidation-resistant, and the $T_mG_n$ compound micro-powder protects the super-fine powder, which significantly improves an anti-oxidation ability of the super-fine powder collected by the filter;

(6) post-mixing:

sending the powder from the cyclone collector and the super-fine powder from the filter into a 2-dimensional or a 3-dimensional mixer under the nitrogen protection for being post-mixed under the nitrogen protection, wherein a post-mixing time is more than 30 min, preferably 60-150 min; after post-mixing, an average particle size of alloy powder is 1-4 μm, preferably 2-3 μm;

(7) providing magnetic field pressing:

after post-mixing, connecting the storage device to a protection atmosphere sorting device, wherein an electronic weighting device is arranged in the protection atmosphere sorting device; after injecting nitrogen gas into the protection atmosphere sorting device, packaging the powder in the storage device into pouches with gloves of the protection atmosphere sorting device under nitrogen protection;

sending the alloy powder into a nitrogen protection sealed magnetic field pressing machine under the nitrogen protection, weighting before adding to a cavity of a mould already assembled, then providing magnetic field pressing; after pressing, returning the mould to a powder feeder, opening the mould and obtaining a magnetic block; wrapping the magnetic block with a plastic or rubber bag under the nitrogen protection for isolating the magnetic block from air, so as to avoid isostatic pressing media immersing the magnetic block during isostatic pressing; then opening an discharging gate for mass-outputting the magnetic block; sending into an isostatic pressing machine for isostatic pressing, and then directly sending the magnetic block which is still wrapped into a nitrogen protection loading tank of a vacuum sintering furnace; unwrapping the magnetic block with gloves in the nitrogen protection loading tank and sending to a sintering case; and (8) sintering and ageing:

sending the sintering case in the nitrogen protection loading tank of the vacuum sintering furnace into a heating chamber of the vacuum sintering furnace, evacuating before heating, keeping a temperature at 200-400° C. for 2-6 h, so as to remove organic impurities; and increasing and keeping the temperature at 400-600° C. for 5-12 h, so as to dehydrogenating and degassing; then keeping the temperature at 600-1025° C. for 5-20 h, so as to pre-sinter, wherein after pre-sintering, a density of the magnetic block is 7.0-7.5 g/cm$^3$, preferably the pre-sintering temperature is kept at 900-1000° C. for 6-15 h, and preferably the density of the magnetic block is 7.2-7.4 g/cm$^3$; during pre-sintering, rare earth diffusion and displacement reactions happen, wherein heavy rare earth elements in the micro-crystal HR—Fe alloy powder and the $T_mG_n$ compound micro-powder which distributed around a $LR_2(Fe_{1-x}Co_x)_{14}B$ phase is displaced by Nd outside the $LR_2(Fe_{1-x}Co_x)_{14}B$ phase for forming a $ZR_2(Fe_{1-x}Co_x)_{14}B$ phase with a high heavy rare earth content; the $ZR_2(Fe_{1-x}Co_x)_{14}B$ phase surrounds the $LR_2(Fe_{1-x}Co_x)_{14}B$ phase, and there is no grain boundary phase therebetween, which forms a main phase structure with the $ZR_2(Fe_{1-x}Co_x)_{14}B$ phase surrounding the $LR_2(Fe_{1-x}Co_x)_{14}B$ phase, wherein the ZR refers to that a heavy rare earth HR content in the main phase is higher than an average heavy rare earth HR content in the NdFeB rare earth permanent magnetic device; the LR refers to that the heavy rare earth HR content in the main phase is lower than the average heavy rare earth HR content in the NdFeB rare earth permanent magnetic device; after entering the grain boundary phase, the Nd is preferentially united with 0 for forming micro $Nd_2O_3$ grains; the micro $Nd_2O_3$ grains in a grain boundary effectively inhibit growth of the $ZR_2(Fe_{1-x}Co_x)_{14}B$ phase; especially, when the micro $Nd_2O_3$ grains are at a border of more than two grains, grain union is effectively inhibited, which inhibits abnormal growth of the grains and significantly increases magnetic coercivity; after pre-sintering, keeping the temperature at 1030-1070° C. for 1-5 h, so as to sinter, wherein after sintering, the magnetic block density ≥7.5 g/cm$^3$; after sintering, firstly ageing at 800-950° C. and secondly ageing at 450-650° C.; after secondly ageing, rapidly cooling for forming a sintered NdFeB permanent magnet; machining and surface-treating the NdFeB permanent magnet for forming a rare earth permanent device.

During sintering and ageing, displacement reaction continuously happens, the coercivity is further improved. Some nano $T_mG_n$ compound powder is displaced by the Nd in a rich Nd phase for forming the $Nd_2O_3$ grains.

After sintering, in the metallographic structure of the NdFeB rare earth permanent magnetic device, micro $T_mG_n$ compound and $Nd_2O_3$ grains exist in a grain boundary phase at a border of more than two $ZR_2(Fe_{1-x}Co_x)_{14}B$ phase grains.

Advantages of the present invention are as follows.

1) During melting, vacuum strip casting technology is used, wherein the average grain size of the alloy flakes is controlled at 2-3 μm, which provides a foundation for manufacturing the high-performance rare earth permanent magnetic material. The micro-crystal HR—Fe alloy fiber is manufactured with vacuum rapid-quenching technology. Decrepitating is easy to happen during jet milling, which is conducive to forming heavy rare earth micro grains. The grains are adsorbed on main phase grains, so as to provide a foundation for improving magnetic performance and anti-corrosion ability of magnets.

The $T_mG_n$ compound micro-powder enters the grain boundary phase and inhibits growth of the grains, in such a manner that the rich Rd phase is distributed evenly, which is conducive to improving magnetic performance and anti-corrosion ability of magnets.

2) During powdering with jet milling, some micro-crystal HR—Fe alloy powder and some $T_mG_n$ compound micro-powder wrap around the super-fine powder for improving anti-oxidant ability of the super-fine powder. After mixing, the super-fine powder and the powder collected from the cyclone collector are mixed, which not only increases material availability, but also improves distribution of rich heavy rare earth micro grains, for providing a foundation for improving magnetic performance of magnets.

3) During sintering, by adding step of pre-sintering, the growth of main phase grains is further inhibited, and diffusion and displacement reactions are enhanced. The heavy rare earth elements in the micro-crystal HR—Fe alloy powder and the $T_mG_n$ compound micro-powder which distributed around a $LR_2(Fe_{1-x}Co_x)_{14}B$ phase is displaced by Nd outside the $LR_2(Fe_{1-x}Co_x)_{14}B$ phase for forming a $ZR_2(Fe_{1-x}Co_x)_{14}B$ phase with a high heavy rare earth content; the $ZR_2(Fe_{1-x}Co_x)_{14}B$ phase surrounds the $LR_2(Fe_{1-x}Co_x)_{14}B$ phase, and there is no grain boundary phase therebetween, which forms a main phase structure with the $ZR_2(Fe_{1-x}Co_x)_{14}B$ phase surrounding the $LR_2(Fe_{1-x}Co_x)_{14}B$ phase. After entering the grain boundary phase, the Nd is preferentially united with O for forming micro $Nd_2O_3$ grains; the micro $Nd_2O_3$ grains in a grain boundary effectively inhibit growth of the $ZR_2(Fe_{1-x}Co_x)_{14}B$ phase; especially, when the micro $Nd_2O_3$ grains are at a border of more than two grains, grain union is effectively inhibited, which inhibits abnormal growth of the grains and significantly increases magnetic coercivity.

Therefore, a significant feature of the present invention is that the structure and the distribution of the grain boundary phase are changed for forming a new structure main phase. The micro $Nd_2O_3$ grains exist at a border of more than two grains.

These and other objectives, features, and advantages of the present invention will become apparent from the following detailed description, the accompanying drawings, and the appended claims.

DETAILED DESCRIPTION OF THE PREFERRED EMBODIMENT

Referring to preferred embodiments, the present invention is further illustrated.

Preferred Embodiment 1

Melting 600 Kg R—Fe—B-M alloy selected from Table 1, casting the alloy in a melted state onto a rotation copper roller with a water cooling function, so as to be cooled for forming alloy flakes; manufacturing micro-crystal HR—Fe alloy fiber (80% HR) with a vacuum rapid-quenching furnace, wherein a rotation speed of a molybdenum wheel is 15 m/s; selecting micro-crystal Dy—Fe alloy fiber and the R—Fe—B-M alloy flakes with a ratio in Table 1 for hydrogen decrepitating; after hydrogen decrepitating, sending the micro-crystal Dy—Fe alloy fiber and the R—Fe—B-M alloy flakes into a mixer, then adding $T_mG_n$ compound micro-powder with a ratio in Table 1; mixing under nitrogen protection for 60 min before powdering with jet milling; sending the powder from the cyclone collector and the super-fine powder from the filter into a post-mixer for being post-mixed, wherein post-mixing is provided under nitrogen protection with a mixing time of 90 min; an oxygen content in protection atmosphere is less than 100 ppm; then sending into a nitrogen protection magnetic field pressing machine for pressing, wherein an orientation magnetic field strength is 1.8 T, an in-cavity temperature is 3° C., a size of a magnet is 40×30×20 mm, and an orientation direction is a 20 size direction; packaging in a protection tank after pressing, then outputting for isostatic pressing; sending into a sintering furnace for pre-sintering, wherein a pre-sintering temperature is kept at 910° C. for 15 h and a pre-sintering density is 7.2 g/cm$^3$; then sintering, firstly ageing and secondly ageing, wherein a sintering is kept at 1070° C. for 1 h; obtaining a magnetic block for being machined, then measuring magnetic performance and weight loss, recording results in Table 1.

Preferred Embodiment 2

Melting 600 Kg R—Fe—B-M alloy selected from Table 1, melting an R—Fe—Co—B-M raw material under vacuum or argon protection with induction heating for forming an alloy, fining at 1400-1470° C. before casting the alloy in a melted state onto a rotation copper roller with a rotation speed of 1 m/s through a tundish, and cooling the alloy with the rotation roller for forming alloy flakes, wherein after leaving the rotation copper roller, the alloy flakes drop to a rotation disk for secondary cooling; manufacturing micro-crystal HR—Fe alloy fiber (80% HR) with a vacuum rapid-quenching furnace, wherein a rotation speed of a molybdenum wheel is 18 m/s; selecting micro-crystal Dy—Fe alloy fiber and the R—Fe—B-M alloy flakes with a ratio in Table 1 for hydrogen decrepitating; after hydrogen decrepitating, sending the micro-crystal Dy—Fe alloy fiber and the R—Fe—B—M alloy flakes into a mixer, then adding $T_mG_n$ compound micro-powder with a ratio in Table 1; mixing under nitrogen protection for 90 min before powdering with jet milling; sending the powder from the cyclone collector and the super-fine powder from the filter into a post-mixer for being post-mixed, wherein post-mixing is provided under nitrogen protection with a mixing time of 120 min; an oxygen content in protection atmosphere is less than 100 ppm; then sending into a nitrogen protection magnetic field pressing machine for pressing, wherein an orientation magnetic field strength is 1.8 T, an in-cavity temperature is 4° C., a size of a magnet is 40×30×20 mm, and an orientation direction is a 20 size direction; packaging in a protection tank after pressing, then outputting for isostatic pressing; sending into a sintering furnace for pre-sintering, wherein a pre-sintering temperature is kept at 950° C. for 12 h and a pre-sintering density is 7.3 g/cm$^3$; then sintering, firstly ageing and secondly ageing, wherein a sintering is kept at 1060° C. for 2 h; obtaining a magnetic block for being machined, then measuring magnetic performance and weight loss, recording results in Table 1.

Preferred Embodiment 3

Melting 600 Kg R—Fe—B-M alloy selected from Table 1, melting an R—Fe—Co—B-M raw material under vacuum or argon protection with induction heating for forming an alloy, fining at 1400-1470° C. before casting the alloy in a melted state onto a rotation copper roller with a rotation speed of 2 m/s through a tundish, and cooling the alloy with the rotation roller for forming alloy flakes, wherein after leaving the rotation copper roller, the alloy flakes drop; crushing the alloy flakes and sending into a receiving tank, then cooling the alloy flakes with inert gas; manufacturing micro-crystal HR—Fe alloy fiber (80% HR) with a vacuum rapid-quenching furnace, wherein a rotation speed of a molybdenum wheel is 22 m/s; selecting micro-crystal Dy—Fe alloy fiber and the R—Fe—B-M alloy flakes with a ratio in Table 1 for hydrogen decrepitating; after hydrogen decrepitating, sending the micro-crystal Dy—Fe alloy fiber and the R—Fe—B-M alloy flakes into a mixer, then adding $T_mG_n$ compound micro-powder with a ratio in Table 1; mixing under nitrogen protection for 90 min before powdering with jet milling; sending the powder from the cyclone collector and the super-fine powder from the filter into a post-mixer for being post-mixed, wherein post-mixing is provided under nitrogen protection with a mixing time of 120 min; an oxygen content in protection atmosphere is less than 100 ppm; then sending into a nitrogen protection magnetic field pressing machine for pressing, wherein a size of a magnet is 40×30×20 mm, and an orientation direction is a 20 size direction; packaging in a protection tank after pressing, then outputting for isostatic pressing; sending into a sintering furnace for pre-sintering, wherein a pre-sintering temperature is kept at 990° C. for 10 h and a pre-sintering density is 7.3 g/cm$^3$; then sintering, firstly ageing and secondly ageing, wherein a sintering is kept at 1050° C. for 3 h; obtaining a magnetic block for being machined, then measuring magnetic performance and weight loss, recording results in Table 1.

Preferred Embodiment 4

Melting 600 Kg R—Fe—B-M alloy selected from Table 1, melting a R—Fe—Co—B-M raw material under vacuum or argon protection with induction heating for forming an alloy, fining at 1400-1470° C. before casting the alloy in a melted state onto a rotation copper roller with a rotation speed of 4 m/s through a tundish, and cooling the alloy with the rotation roller for forming alloy flakes, wherein a temperature of the alloy flakes is more than 400° C. and less than 700° C., after leaving the rotation copper roller, the alloy flakes drop to a cooling plate for secondary cooling to a temperature of less than 400° C.; crushing the alloy flakes and then keeping the temperature at 200-600° C. before cooling the alloy flakes with inert gas; manufacturing micro-crystal HR—Fe alloy fiber (80% HR) with a vacuum rapid-quenching furnace, wherein a rotation speed of a molybdenum wheel is 25 m/s; selecting micro-crystal Dy—Fe alloy fiber and the R—Fe—B-M alloy flakes with a ratio in Table 1 for hydrogen decrepitating; after hydrogen decrepitating, sending the micro-crystal Dy—Fe alloy fiber and the R—Fe—B-M alloy flakes into a mixer, then adding $T_mG_n$ compound micro-powder with a ratio in Table 1; mixing under nitrogen protection for 120 min before powdering with jet milling; sending the powder from the cyclone collector and the super-fine powder from the filter into a post-mixer for being post-mixed, wherein post-mixing is provided under nitrogen protection with a mixing time of 120 min; an oxygen content in protection atmosphere is less than 100 ppm; then sending into a nitrogen protection magnetic field pressing machine for pressing, wherein a size of a magnet is 40×30×20 mm, and an orientation direction is a 20 size direction; packaging in a protection tank after pressing, then outputting for isostatic pressing; sending into a sintering furnace for pre-sintering, wherein a pre-sintering temperature is kept at 1010° C. for 8 h and a pre-sintering density is 7.3 g/cm$^3$; then sintering, firstly ageing and secondly ageing, wherein a sintering is kept at 1040° C. for 4 h; obtaining a magnetic block for being machined, then measuring magnetic performance and weight loss, recording results in Table 1.

Preferred Embodiment 5

Melting 600 Kg R—Fe—B-M alloy selected from Table 1, casting the alloy in a melted state onto a rotation copper roller with a water cooling function, so as to be cooled for forming alloy flakes; manufacturing micro-crystal HR—Fe alloy fiber (80% HR) with a vacuum rapid-quenching furnace, wherein a rotation speed of a molybdenum wheel is 28 m/s; selecting micro-crystal Dy—Fe alloy fiber and the R—Fe—B-M alloy flakes with a ratio in Table 1 for hydrogen decrepitating; after hydrogen decrepitating, sending the micro-crystal Dy—Fe alloy fiber and the R—Fe—B-M alloy flakes into a mixer, then adding $T_mG_n$ compound micro-powder with a ratio in Table 1; mixing under nitrogen protection for 120 min before powdering with jet milling; sending the powder from the cyclone collector into a post-mixer for being post-mixed, wherein post-mixing is provided under nitrogen protection with a mixing time of 150 min; then sending into a nitrogen protection magnetic field pressing machine for pressing, wherein a size of a magnet is 40×30×20 mm, and an orientation direction is a 20 size direction; packaging in a protection tank after pressing, then outputting for isostatic pressing; sending into a sintering furnace for pre-sintering, wherein a pre-sintering temperature is kept at 1020° C. for 6 h and a pre-sintering density is 7.4 g/cm$^3$; then sintering, firstly ageing and secondly ageing, wherein a sintering is kept at 1030° C. for 5 h; obtaining a magnetic block for being machined, then measuring magnetic performance and weight loss, recording results in Table 1.

Contrast Example

Melting 600 Kg R—Fe—B-M alloy selected from Table 1, casting the alloy in a melted state onto a rotation copper roller with a water cooling function, so as to be cooled for forming alloy flakes; hydrogen decrepitating before powdering with jet milling; then sending into a nitrogen protection magnetic field pressing machine for pressing, wherein an orientation magnetic field strength is 1.8 T, an in-cavity temperature is 3° C., a size of a magnet is 40×30×20 mm, and an orientation direction is a 20 size direction; packaging in a protection tank after pressing, then outputting for isostatic pressing; sending into a sintering furnace for sintering, firstly ageing and secondly ageing,; obtaining a magnetic block for being machined, then measuring magnetic performance and weight loss, recording results in Table 1.

TABLE 1 compound and performance in preferred embodiments and contrast example

| embodiment | | preferred embodiment 1 | preferred embodiment 1 | preferred embodiment 2 | preferred embodiment 3 | preferred embodiment 4 | preferred embodiment 5 | contrast example |
|---|---|---|---|---|---|---|---|---|
| R-Fe-B-M alloy (Wt %) | Nd | 20 | 20 | 20 | 20 | 20 | 20 | 20 |
| | Pr | 5 | 5 | 5 | 5 | 5 | 5 | 5 |
| | Dy | 0 | 1 | 2 | 3 | 4 | 4 | 4 |
| | Tb | 2 | 2 | 0 | 0.5 | 1 | 2 | 2 |
| | Fe | the rest | the rest | the rest | the rest | the rest | the rest | the rest |
| | Co | 2.4 | 2.4 | 2.4 | 2.4 | 2.4 | 2.4 | 2.4 |
| | Cu | 0.2 | 0.2 | 0.2 | 0.2 | 0.2 | 0.2 | 0.2 |
| | B | 0.9 | 0.9 | 0.9 | 0.9 | 0.9 | 0.9 | 0.9 |
| | Al | 0.2 | 0.2 | 0.2 | 0.2 | 0.2 | 0.2 | 0.2 |
| | Ga | 0.1 | 0.1 | 0.1 | 0.1 | 0.1 | 0.1 | 0.1 |
| | Zr | 0.1 | 0.1 | 0.1 | 0.1 | 0.1 | 0.1 | 0.1 |
| HR-Fe (Wt %) | Dy-Fe | 4 | 3 | 2 | 1 | | | |
| | Tb-Fe | | | 2 | 1.5 | 1 | | |
| $T_mG_n$ (Wt %) | $Dy_2O_3$ | 0.01 | | 0.01 | 0.03 | 0.05 | 0.1 | |
| | $Tb_2O_3$ | 0.01 | | 0.01 | 0.03 | 0.05 | 0.1 | |
| | $Y_2O_3$ | | 0.01 | 0.02 | | | | |
| | $Al_2O_3$ | 0.01 | 0.01 | 0.02 | 0.03 | 0.05 | 0.1 | |
| | ZrO | | 0.01 | | | 0.05 | | |
| | BN | | 0.01 | | 0.03 | | | |
| | total | 0.03 | 0.04 | 0.06 | 0.12 | 0.2 | 0.3 | |
| magnetic energy product (MGOe) | | 40.7 | 41.2 | 42.6 | 41.5 | 39.8 | 38.8 | 38.5 |
| coercivity (KOe) | | 23.9 | 24.9 | 26.5 | 24.7 | 23.3 | 21.6 | 20.5 |
| weight loss (mg/cm$^2$) | | 1.3 | 1.2 | 0.9 | 0.7 | 1.8 | 2.7 | 5.4 |

It is further illustrated by the preferred embodiments and the contrast example that the method and the device according to the present invention significantly improve magnetic performance. Compared with Dy infiltration technology, the present invention is low in cost, and is not limited by shapes and sizes of magnets. Therefore, the method and the device have a brilliant future.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A method for manufacturing a high-performance NdFeB rare earth permanent magnetic device, wherein the high-performance NdFeB rare earth permanent magnetic device is made of an R—Fe—Co—B—M strip casting alloy, a micro-crystal HR—Fe alloy fiber, and $T_mG_n$ compound micro-powder, wherein the R comprises at least two rare earth elements, wherein the R at least comprises Nd and Pr;

the M is selected from a group consisting of Al, Co, Nb, Ga, Zr, Cu, V, Ti, Cr, Ni and Hf;

the HR is selected from a group consisting of Dy, Tb, Ho and Y;

the $T_mG_n$ compound micro-powder is selected from a group consisting of $La_2O_3$, $Ce_2O_3$, $Dy_2O_3$, $Tb_2O_3$, $Y_2O_3$, $Al_2O_3$, $ZrO_2$ and BN;

Fe, B, Co, O and N are element symbols of corresponding elements;

the method comprising steps of:

(1) manufacturing the R—Fe—Co—B—M strip casting alloy:

firstly melting an R—Fe—Co—B—M raw material under vacuum or argon protection with induction heating for forming an alloy, fining before casting the alloy in a melted state onto a rotation roller through a tundish, and cooling the alloy with the rotation roller for forming alloy flakes, outputting the alloy flakes after being cooled;

wherein an average grain size of the strip casting alloy is 1-4 μm;

(2) manufacturing the micro-crystal HR—Fe alloy fiber:

adding an HR—Fe alloy into a water-cooled cooper crucible of an arc-heating vacuum quenching furnace under an argon atmosphere, melting the HR—Fe alloy with an electric arc, contacting melted alloy liquid with a periphery of a water-cooled high-speed rotating molybdenum wheel, in such a manner that the melted alloy liquid is thrown out for forming the micro-crystal HR—Fe alloy fiber; wherein a speed of the periphery of the water-cooled high-speed rotating molybdenum wheel is higher than 10 m/s;

(3) providing hydrogen decrepitating:

sending the R—Fe—Co—B—M strip casting alloy flakes and the micro-crystal HR—Fe alloy fiber into a vacuum hydrogen decrepitation device, evacuating before injecting hydrogen for hydrogen absorption, wherein a hydrogen absorption temperature is 80-120° C.; heating after hydrogen absorption and evacuating for dehydrogenating, wherein a dehydrogenating temperature is 350-900° C., a temperature keeping time is 3-15 h; cooling after temperature keeping, outputting after a temperature is lower than 80° C.;

(4) pre-mixing:

adding the alloy flakes which is hydrogen decrepitated in the step (3), the micro-crystal HR—Fe alloy fiber which is hydrogen decrepitated in the step (3) and the $T_mG_n$ compound micro-powder into a mixer for pre-mixing, wherein pre-mixing is provided under nitrogen protection, a pre-mixing time is more than 30 min; powdering with nitrogen protected jet milling after mixing;

(5) powdering with jet milling:

after pre-mixing, adding powder into a hopper on a top portion of a feeder, moving the pre-mixed powder into a milling room through the feeder, milling with high-speed flow from a spray nozzle, wherein the powder milled rises with the flow; sorting powder suitable for powdering with a sorting wheel and collecting in a cyclone collector; wherein coarse powder unsuitable for powdering returns with a centrifugal force to the milling room for milling; storing the powder collected as an end product in a storage device under the cyclone collector, filtering super-fine powder outputted with outputting gas of the cyclone collector with a filter and storing in a super-fine powder collector under the filter; wherein the outputting gas enters a gas entry of a nitrogen compressor and then is compressed to 0.6-0.8 MPa by the nitrogen compressor before being sprayed through the spray nozzle, nitrogen is re-used, an oxygen content in a powdering atmosphere is less than 100 ppm;

(6) post-mixing:

sending the powder from the cyclone collector and the super-fine powder from the filter into the mixer under the nitrogen protection for being post-mixed under the nitrogen protection, wherein a post-mixing time is more than 60 min; after post-mixing, an average grain size of alloy powder is 1-4 μm;

(7) providing magnetic field pressing:

sending the alloy powder into a nitrogen protection sealed magnetic field pressing machine under the nitrogen protection, weighting before adding to a cavity of a mould already assembled, then providing magnetic field pressing; after pressing, returning the mould to a powder feeder, opening the mould and obtaining a magnetic block; wrapping the magnetic block with a plastic or rubber bag under the nitrogen protection for isolating the magnetic block from air, so as to avoid isostatic pressing media immersing the magnetic block during isostatic pressing; then opening an discharging gate for mass-outputting the magnetic block; sending into an isostatic pressing machine for isostatic pressing, and then directly sending the magnetic block which is still wrapped into a nitrogen protection loading tank of a vacuum sintering furnace; unwrapping the magnetic block with gloves in the nitrogen protection loading tank and sending to a sintering case; and (8) sintering and ageing:

sending the sintering case in the nitrogen protection loading tank of the vacuum sintering furnace into a heating chamber of the vacuum sintering furnace, evacuating before heating, keeping a temperature at 200-400° C. for 2-6 h, so as to remove organic impurities; and increasing and keeping the temperature at 400-600° C. for 5-12 h, so as to dehydrogenate and degas; then keeping the temperature at 600-1025° C. for 5-20 h, so as to pre-sinter; after pre-sintering, keeping the temperature at 1030-1070° C. for 1-5 h, so as to sinter; after sintering, firstly ageing at 800-950° C. and secondly ageing at 450-650° C.; after secondly ageing, rapidly cooling for forming a sintered NdFeB permanent magnet; machining and surface-treating the NdFeB permanent magnet for forming a rare earth permanent device.

2. The method, as recited in claim 1, wherein the $T_mG_n$ compound micro-powder is selected from a group consisting of $Dy_2O_3$, $Tb_2O_3$ and $Y_2O_3$.

3. The method, as recited in claim 1, wherein the $T_mG_n$ compound micro-powder is selected from a group consisting of $Al_2O_3$ and $ZrO_2$.

4. The method, as recited in claim 1, wherein the $T_mG_n$ compound micro-powder refers to compound micro-powder of BN.

5. The method, as recited in claim 1, wherein the R comprises at least two members selected from La, Ce, Gd, Nd and Pr, wherein the R at least comprises Nd and Pr.

6. The method, as recited in claim 1, wherein the R comprises at least two members selected from La, Ce, Gd, Dy, Nd and Pr, wherein the R at least comprises Nd and Pr.

7. The method, as recited in claim 1, wherein the R comprises La, Ce, Nd and Pr.

8. The method, as recited in claim 1, wherein an adding amount of the micro-crystal HR—Fe alloy fiber is 1-8 wt. %.

* * * * *